United States Patent [19]

Evans

[11] Patent Number: 4,645,201

[45] Date of Patent: Feb. 24, 1987

[54] EXERCISE MACHINE

[75] Inventor: Harold R. Evans, St. Brelade, Channel Islands

[73] Assignee: Tekron Licensing B.V., Lomboklaan, Netherlands

[21] Appl. No.: 555,977

[22] Filed: Nov. 29, 1983

[30] Foreign Application Priority Data

Nov. 30, 1982 [GB] United Kingdom ..... 8234044

[51] Int. Cl.[4] ..... A63B 69/18; A63B 1/00

[52] U.S. Cl. ..... 272/97; 272/70

[58] Field of Search ..... 272/72, 73, DIG. 5, 272/97, 70, 69, 133, 131, 120, 121, 126; 273/55 R

[56] References Cited

U.S. PATENT DOCUMENTS

| | | | |
|---|---|---|---|
| 1,982,843 | 12/1934 | Traver | 272/70 |
| 3,472,510 | 10/1969 | Holkesvick | 273/55 R |
| 3,475,021 | 10/1969 | Ruegsegger | 272/97 |
| 3,582,069 | 6/1971 | Flick | 272/70 |
| 4,402,506 | 9/1983 | Jones | 272/97 |
| 4,434,981 | 3/1984 | Norton | 272/97 |

FOREIGN PATENT DOCUMENTS

| | | | |
|---|---|---|---|
| 2631897 | 1/1978 | Fed. Rep. of Germany | 272/97 |
| 2410486 | 8/1979 | France | 272/97 |
| 2007987 | 5/1979 | United Kingdom | 272/70 |
| 2010101 | 6/1979 | United Kingdom | 272/DIG. 5 |
| 1599394 | 9/1981 | United Kingdom | 272/70 |

*Primary Examiner*—Richard J. Apley
*Assistant Examiner*—S. R. Crow
*Attorney, Agent, or Firm*—Price, Heneveld, Cooper, DeWitt & Litton

[57] ABSTRACT

An exercise machine for simulating cross-country skiing comprising a pair of side rails two end members, two runners running along the side rails and a base plate to which a pair of ski poles are attached. The runners are connected by a flat nylon webbing tape which slides frictionally over the end members as the runners are moved backwards and forwards.

12 Claims, 6 Drawing Figures

EXERCISE MACHINE

BACKGROUND OF THE INVENTION

The present invention relates to exercise machines.

It has long been acknowledged that exercise, taken in moderate amounts can improve health and this is reflected in the current increase in exercising activities such as running, jogging, swimming etc. However, it may be preferable to perform exercises indoors rather than in an outdoor environment perhaps due to weather conditions or unpleasant environmental conditions in the case of city-dwellers, particularly those living in high-rise accommodation. Furthermore, it may not be convenient to visit a gymnasium or an exercise centre and so there is a need for devices which enable exercise to be taken in the home. In this way, small amounts of regular exercise may be taken with a minimum of inconvenience and disruption to daily routines, resulting in an improved health, an increased life-expectancy and a general feeling of well-being.

It is believed in certain circles that violent exercise may actually be harmful to one's health in the long term, quite apart from the short term risks of injury heart failure etc. Thus, it would be desirable to provide a device which enables the user to perform exercises at his or her own pace without placing any great strain on the body. Such a device could perhaps offer most beneficiently a substantially constant resistance which has to be overcome either continuously or repeatedly by the user performing the exercise.

SUMMARY OF THE INVENTION

It is an object of the present invention to provide an exercise machine which simulates the action of jogging or skiing, particularly cross-country skiing or langlauf.

According to the invention an exercise machine comprises a pair of substantially horizontal tracks, a pair of runners, one mounted for movement along each track, a flexible elongate friction element connected between the runners, a frictional guide surface over which the flexible elongate friction element slides frictionally upon movement of the runners, and optionally a pair of substantially vertical rods associated with the tracks.

With such a machine, a user can simulate a run of some miles or a period of cross-country skiing without having to leave his or her own home. This minimises the risk of injury associated with actual running or skiing. Furthermore, it is not necessary to decide beforehand on the particular distance to be covered so that the desired amount of exercise may be taken with a greater degree of accuracy.

Preferably, the tracks are parallel, spaced and connected together at each end by a cross member. Preferably each cross member is in the form of a tube bent through a right angle. The flexible elongate friction element may then extend along one track from one runner to the tube, pass around the tube, turning through 180°, and then pass along the other track to the other runner. The flexible elongate friction element is preferably arranged in this way at both ends of the tracks, thereby ensuring complementary movement of the runners. With the latter arrangement, the friction element would effectively form a continuous loop with the runners attached at substantially opposite positions. Alternatively, the tape could be in the form of two half-loops joined together at the two runners.

Preferably each track comprises a rectangular section tube with a rail attached to each side. Each runner then preferably comprises a foot support mounted on a carriage, the carriage having wheels running along the rails and a flange located beneath the rail. Alternatively, the carriages may have slides instead of wheels allowing them to slide along the rails.

The rods or poles may be pivotally attached to a base plate, preferably by means of strong springs, in order to allow the poles to swing about the vertical position. In a preferred embodiment, the spring is a force-fit on to a stud on the base plate and has an insert force-fitted into its top end. The insert may have an integral screw-threaded spigot arranged to screw into a corresponding tapped hole in one of the poles, so that the poles can be unscrewed for storage of the machine.

The flexible elongate friction element is preferably a flat nylon webbing tape and the machine may be equipped with a tape tension adjuster in order to vary the tape tension and so the frictional resistance to movement. A counter may also be provided to give an indication of the exercise performed.

DESCRIPTION OF THE PREFERRED EMBODIMENT

Figure 1:
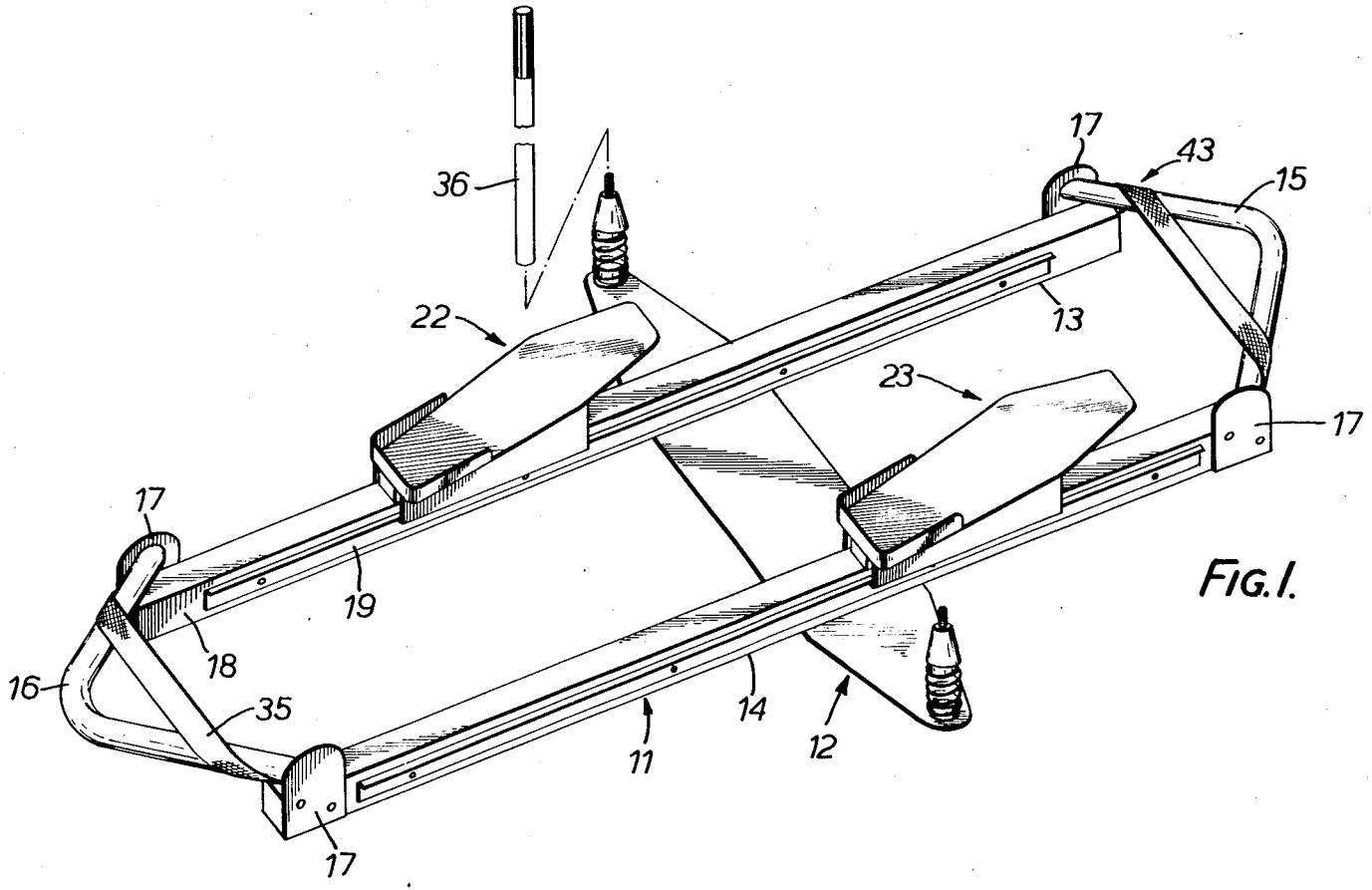
FIG. 1 is an isometric sketch of an exercise machine in accordance with the invention, with some components omitted for clarity.

As shown in FIG. 1, the exercise device comprises essentially a frame 11 and a base plate 12. The frame 11 comprises two side members 13, 14 and two end members 15, 16. The side and end members 13 to 16 are connected to form the frame 11 by means of four corner plates 17 to which the end members are welded, the corner plates being bolted to the side members. The side members 13, 14 stand on shallow rubber feet (not shown) there being two at each corner.

Each side member 13, 14 comprises a rectangular section tube 18 and a pair of L-section rails 19, 21 extending along the side member, one on either side. Each end member 15, 16 comprises a length of smooth round sectioned tubing which has been bent through 90° and these end members 15, 16 are attached to the side members 13, 14 so that the 90° bend in each case faces outwards.

Figure 2:
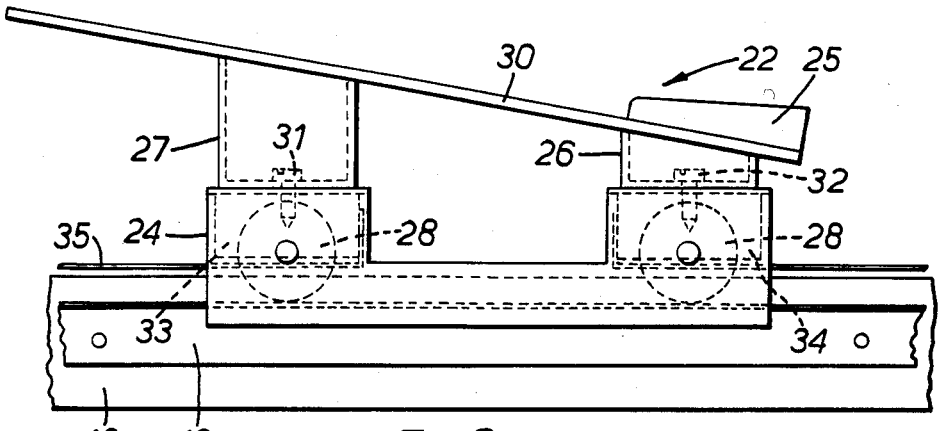
FIG. 2 is a side view to a larger scale and in more detail of a runner.
Figure 3:
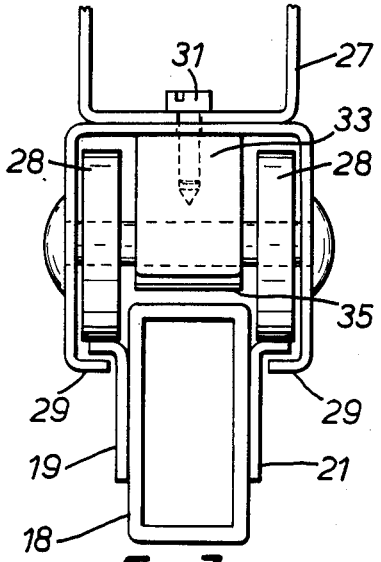
FIG. 3 is an end view of the runner of FIG. 2.

The machine includes two runners 22, 23, one of which is mounted on each side member 13, 14. The two runners are similar in construction and one is shown in more detail in FIG. 2. The runner 22 comprises a foot pad 30 and a trolley 24. The foot pad 30 includes a heel retainer 25 at the rear, a rear support pillar 26 and a front support pillar 27. The trolley 24 comprises a body within which four wheels 28 are mounted so that they run along the rails 19 and 21. When the trolley 24 is in position on the side member 13, inwardly directed flanges 29 are located beneath the outwardly extended portions of the rails 19, 21. The foot pad 30 is rigidly connected to the trolley 24 by means of bolts 31, 32 which pass through the base of the front and rear support pillars 27, 26 and into two blocks 33, 34 at the front and rear of the trolley 24. Thus, the runner 22 is retained in position on the side member 18 but is free to run along it.

A flat tape of nylon webbing 35 is connected between the two runners and extends around the frame 11. One portion of the tape 35 has one end connected to the front block 33 of the runner 22. This portion of the tape extends forward along the side member 13 up to the end member 15. The tape passes beneath the end member 15 and performs a 90° turn to extend across the bend in the end member. When the tape meets the end member once again it performs a similar 90° turn emerging beneath the end member and extending along the other side member 14 until it reaches the other runner 23. The other end of this portion of the tape is then attached to the front block 33 of this runner 23.

A second portion of the tape 35 has its ends attached to the two rear blocks 34 of the runners 22 and 23, extending backwards along the two side members 13, 14 and around the end member 16 in a similar fashion.

Although the tape 35 is shown in this embodiment as being in two sections, it could equally well be in one piece. As will be appreciated, in either case, the connection of the tape 35 between the runners 22, 23 ensures complementary movement of these runners along the side members.

Figure 4:
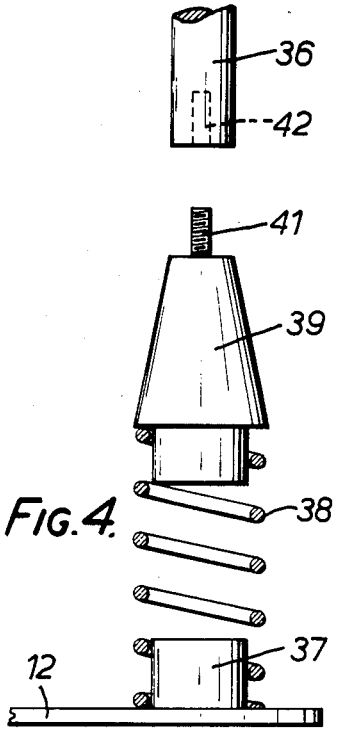
FIG. 4 is a partial sectional elevation showing the mounting of a pole.

The machine also includes a pair of poles 36 which are intended to simulate ski-poles. Only one is shown in FIG. 1; two are mounted on the base plate 12 as shown most clearly in FIG. 4. The base plate 12 is a generally flat plate located beneath the side members 13, 14 and arranged transversely. It is attached to the side members 13, 14 by means of small upstanding spigots (not shown) which extend into corresponding holes (not shown) in the underside of the side members 13, 14. A series of these holes are provided so that the position of the base plate 12 can be adjusted.

At each end of the base plate 12 there is an upstanding stud 37. A strong spring 38 is forced over the stud 37 so that it is firmly located and an insert 39 is forced into the upper end of the spring 38. A threaded spigot 41 extends from the top of the insert 39 and the poles 36 are formed with a corresponding tapped hole 42 thus enabling the poles 36 to be attached to the base plate 12.

In use, the user places his feet on the foot pads 30 and grasps the poles 36 which may have hand grips if desired. The user then performs a cross-country skiing motion by a combination of thrusting backwards on one pole and moving the opposite foot backwards while thrusting one foot forward and moving the opposite pole forwards. This is repeated resulting in a reciprocating movement of the tape 35. As will be appreciated, the tape slides frictionally over the end members 15, 16 resulting in a resistance to the motion.

Figure 5:
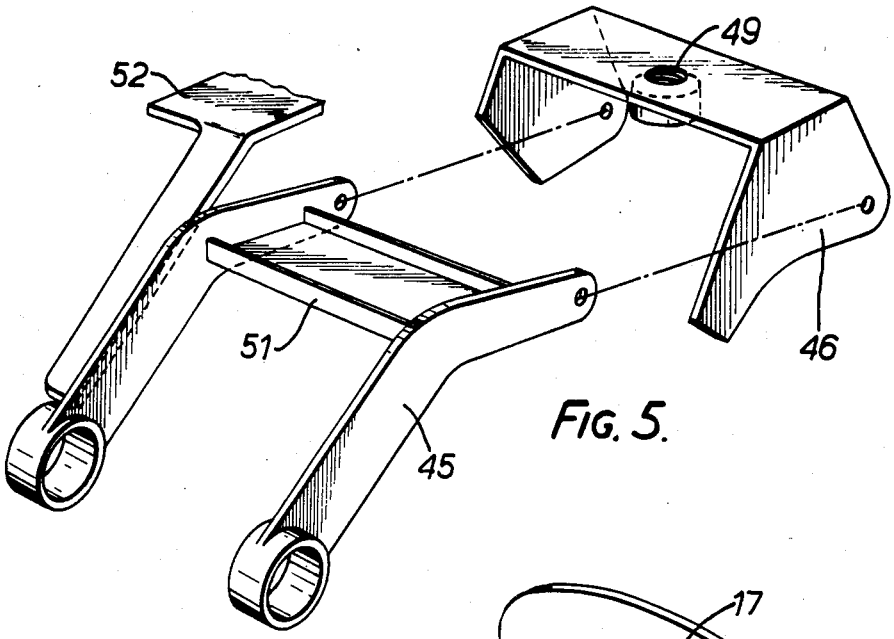
FIG. 5 is an isometric sketch of the two major components of the tape-tensioning and counter device.
Figure 6:
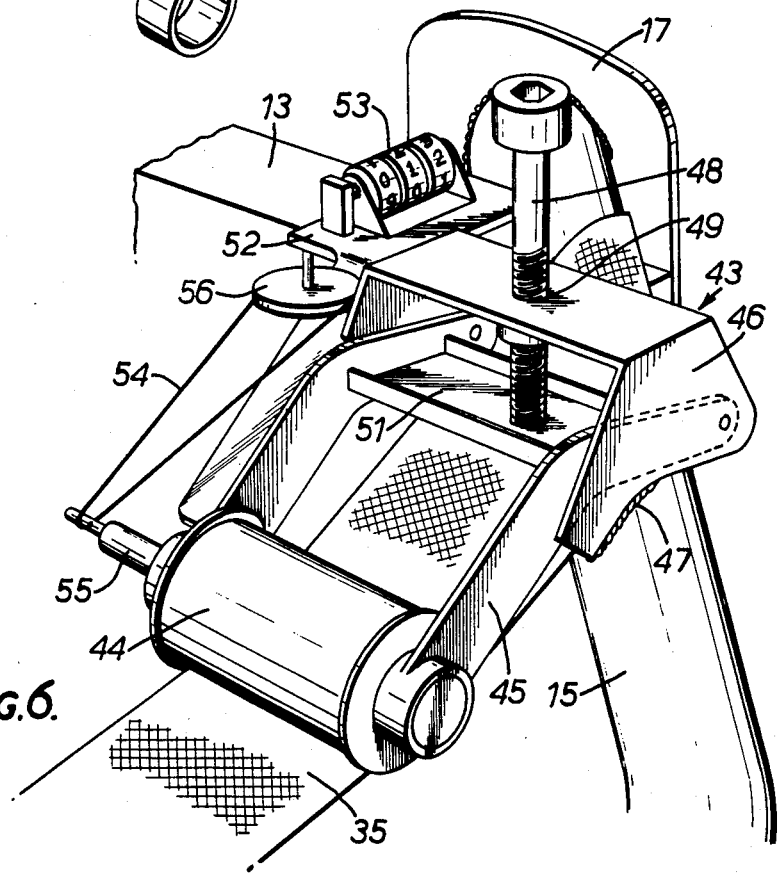
FIG. 6 is an isometric sketch of the tape-tensioning and counter device in position.

In order to adjust the resistance to movement a device is included which adjusts the tension in the tape 35. This would occupy the position generally indicated at 43 in FIG. 1 and the device itself is shown in detail in FIGS. 5 to 6. The device also incorporates a counter to give a visual indication of the amount of exercise performed.

The tensioning device comprises a roller 44 mounted for rotation in a roller support 45. The roller support is pivotally mounted in a mounting bracket 46 which is welded to the end member 15 as shown at 47.

An adjustment bolt 48 passes through a tapped hole 49 in the top of the bracket 46 and contacts a plate 51 on the roller support 45. Thus, by rotating the adjustment bolt 48 so that it moves downwards through the tapped hole 49 and against the plate 51, the roller support can be pivoted relative to the mounting bracket 46 and the roller 44 is forced downwards against the tape 35, thus increasing the tension.

The roller support 35 also has a counter support ledge 52 on one side, on which a counter 53 is mounted. A belt 54 passes around the spindle 55 of the roller 44 and also around a gear wheel 56 connected to the counter mechanism. The counter 53 is provided with a ratchet mechanism so that it records movements of the tape 35 in one direction only. The counter is also provided with a zero-set mechanism. Thus, the user of the machine can monitor the amount of exercise which he is performing.

Although not shown, covers may be provided at each end of the exercise machine for protection and for aesthetic reasons. Suitable apertures would be provided in the cover at the front end so that the adjustment bolt 48 could be operated and so that the counter 53 could be viewed.

In order to assist the user in returning his feet after reaching fore and aft limit of travel of runners 22, 23 the ends of the size members 13, 14 may be angled upwards. Alternatively or in addition, return springs (not shown) may be provided.

In order to ensure that the machine remains stable when a user places only one foot on one of the runners 22, 23 in mounging the machine, stays (not shown) may be attached to the side members 13, 14 extend outwards laterally.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by letters patent of the United States is:

1. An exercise machine comprising:

a pair of horizontal, parallel rails each having a front end and a back end and each having a top and a pair of sides;

cross member means for extending between and joining said rail front ends and for extending between and joining said rail back ends;

a pair of runners one each mounted on one of said rails and including means for receiving a foot of a user, each runner extending about said top and a portion of both said sides of said rail to securely position said runner on said rail, each runner further including roller means for supporting said runner for rolling movement on said rail;

an elongated flexible tension means fixedly connected to said runners and forming a closed loop with said runners, whereby movement of said runners is synchronized, said tension means extending the full length of each rail between said front and back, said tension means extending between said rails at the front rail ends and at the back rail ends;

four frictional guides one each located proximate one of the interconnections between one of said rail ends and said cross member means, said frictional guides supporting said tension means in a rectangular shape and providing frictional resistance to said tension means during all movement of said runners; and adjustable friction means for applying additional, readily adjustable, uniform frictional resistance to said tension means during all movement of said runners, whereby said exercise machine provides an adjustably uniform resistance to all movement of said runners to simulate the activity of cross-country skiing.

2. An exercise machine comprising:

a pair of horizontal, parallel rails each having a front end and a back end;

cross member means for extending between and joining said rail front ends and for extending between and joining said rail back ends;

a pair of runners one each mounted on one of said rails and including means for receiving a foot of a user, each runner further including means for supporting said runner for movement on said rail;

an elongated flexible tension means fixedly connected to said runners and forming a closed loop with said runners, whereby movement of said runners is synchronized, said tension means extending the full length of each rail between said front and back ends, said tension means extending between said rails at said front rail ends and at said back rail ends;

four frictional guides one each located proximate one of the interconnections between one of said rail ends and said cross member means, said frictional guides supporting said tension means in a rectangular shape and providing frictional resistance to said tension means during all movement of said runners; and adjustable friction means for applying additional, readily adjustable, uniform frictional resistance to said tension means during all movement of said runners, whereby said exercise machine provides an adjustably uniform resistance to all movement of said runners to simulate the activity of cross-country skiing.

3. An exercise machine according to claim 1 wherein said cross-member means comprise two tubes, one at each end of said rails.

4. An exercise machine according to claim 3 wherein each said tube is bent to form two portions joined by a right angle the apex of which extends away from and generally parallel to said rails, each tube portion comprising one of said frictional guides.

5. An exercise machine according to claim 1 wherein each rail comprises a rectangular section tube and tracks attached to each side of said rectangular section tube, and further wherein said roller means engage said tracks.

6. An exercise machine according to claim 1 further including a pair of substantially vertical rods associated with said rails, whereby said rods can be grasped by a user to simulate ski-poles.

7. An exercise machine according to claim 6 further including a base plate to which said rails are attached and to which said rods are pivotally attached.

8. An exercise machine according to claim 1 wherein said tension means comprises a flat nylon webbing tape.

9. An exercise machine according to claim 7 wherein the medial position of the runner is arranged to be somewhat behind the position of said rods having regard to the direction a user would face when using the machine.

10. An exercise machine as described in claim 7 further comprising spring means for resiliently securing each of said rods to said base plate.

11. An exercise machine according to claim 2 wherein each rail comprises a rectangular section tube and tracks attached to each side of said rectangular section tube, and further wherein said runner supporting means engages said tracks.

12. An exercise machine according to claim 2 wherein said tension means comprises a flat nylon webbing tape.

* * * * *